US005307828A

United States Patent [19]

Gardner et al.

[11] Patent Number: 5,307,828

[45] Date of Patent: May 3, 1994

[54] SUPPORT FOOT ASSEMBLY

[76] Inventors: Donald J. Gardner; Sue A. Gardner, both of 134 Kohler St., Tonawanda, N.Y. 14150

[21] Appl. No.: 72,163

[22] Filed: Jun. 4, 1993

[51] Int. Cl.[5] ..... A45B 9/04

[52] U.S. Cl. ..... 135/82; 135/86; 135/84; 135/78; 135/77

[58] Field of Search ..... 135/86, 84, 82 DR, 87, 135/78, 77

[56] References Cited

U.S. PATENT DOCUMENTS

| | | | |
|---|---|---|---|
| 450,041 | 4/1891 | Russell . | |
| 679,468 | 7/1901 | Pratt | 135/84 |
| 3,467,117 | 9/1969 | Lucibello | 135/86 |
| 4,098,283 | 7/1978 | Tritle . | |
| 4,562,851 | 1/1986 | Frank | 135/84 |
| 4,708,154 | 11/1987 | Edwards . | |
| 4,899,771 | 2/1990 | Wilkinson . | |
| 4,947,882 | 8/1990 | Levasseur . | |
| 4,964,430 | 10/1990 | Janis | 135/78 |
| 5,167,746 | 12/1992 | Sheenan . | |

FOREIGN PATENT DOCUMENTS

| | | | |
|---|---|---|---|
| 2668690 | 5/1992 | France . | |
| 0591827 | 9/1977 | Switzerland | 135/77 |

OTHER PUBLICATIONS

Futuro Item No. 292600 "Super Grip" Crutch Tips.

*Primary Examiner*—Carl D. Friedman
*Assistant Examiner*—Wynn E. Wood
*Attorney, Agent, or Firm*—John C. Thompson

[57] ABSTRACT

A support foot assembly (10) for use with a elongated load bearing device such as a cane (16) or crutch. The support foot assembly includes a mounting structure (12) having a generally planar bottom surface (12.1) and an upper surface (12.2) which, in the preferred form of the invention shown in the accompanying drawings, is provided with a large, deep generally cylindrical cavity (12.3). Securing means (14) are provided to secure the elongated load bearing device to the mounting structure, and to this end a rubber-like crutch or cane tip (18) is mounted within the cavity (12.3), the tip (18) being retained within the cavity by a rubber-like cord (22) which passes through a small aperture (12.5) below the cavity (12.3), the cord having an enlarged portion (22.1) which engages the bottom surface (12.1) of the mounting structure. Engaging means (26) project downwardly from the bottom surface of the mounting structure, the engaging means including a plurality of spaced apart bristle tufts (28), and a plurality or rubber fingers (32) interspersed among the bristle tufts. In the preferred form illustrated the rubber fingers are formed by coating alternating bristle tufts with neoprene.

20 Claims, 1 Drawing Sheet 10
12
12.1
12.2
12.3
12.4
12.5
12.6
14
16
16.1
18
18.1
18.2
18.3
20
22
22.1
22.2
22.3
24
26
28
30
32
32.1
W
L
T
2
3
5

SUPPORT FOOT ASSEMBLY

TECHNICAL FIELD

The present invention relates generally to a novel support foot assembly which is capable of adhering to substantially all support surfaces without slipping, the surfaces including ice, snow, wet floors, wood, and carpet. More particularly, the present invention relates to a support foot assembly which may be used with walking aids such as canes or crutches, which support foot assembly will adhere to substantially all surfaces, which will give the user of a cane security when the cane is extended far in front of the user, and which will also permit a cane to stand by itself.

BACKGROUND OF THE INVENTION

Walking aids, such as canes and crutches, are typically provided with removable rubber-like tips, the purpose of the tip being to prevent damage to a walking surface from the walking aid, and also, more importantly, to give good adhesion between the bottom of the walking aid and the walking surface. The most common cane tip in use today is circular, when viewed from the bottom, and has concentric grooves in a slightly concave surface. This form of tip does not work well on all surfaces, and particularly ice and some wet floors. It has a further disadvantage in that, as dust packs within the cane tip, it loses its ability to adhere to wood floors. An ice pick, which can be swung over a rubber tip, is commonly used by people with canes, and a pick will give them some feeling of security on icy surfaces. However, it is necessary for them to swing the ice pick out of the way when they enter a building in order to prevent damage to the floors within the building. Another disadvantages of the common rubber-like cane tips is that they will not permit the cane to stand upon the floor in a free standing mode. Also, because the common tip has only limited flexibility, it does not give the user of the cane security when the cane is extended far in front of the user.

Various patents have issued which have attempted to address the above problems. For example U.S. Pat. No. 4,708,154 to Edwards discloses a no-slip crutch foot with flexible fingers 56. U.S. Pat. No. 4,947,882 to Levasseur discloses a walking stick tip or foot having a large area and has 5 spaced apart cylindrical projections. U.S. Pat. No. 4,899,771 to Wilkinson discloses a cane tip of rectangular design, the tip having a large area with ridges 20 on the bottom surface thereof. In addition to the above patents, U.S. Pat. No. 5,167,746 to Sheenan discloses a shoe-like crutch tip, wherein the shoe shown in FIG. 7 is provided with cleats 22. Another U.S. Patent which discloses tips for walking aids is 4,098,283. However, none of the foregoing patented designs have successfully provided a structure which will adhere to virtually all walking surfaces.

OBJECTS AND SUMMARY OF THE INVENTION

It is an object of the present invention to provide a support foot assembly which may be used with a elongated load bearing device such as a cane or crutch, which support foot assembly is capable of adhering to substantially all support surfaces without slipping, including ice, snow, wet floors, wood, and carpet, and which, when used with a cane, gives the user of the cane security when the cane is extended far in front of the user, and which will also permit the cane to stand by itself.

The novel support foot assembly of this invention includes a mounting structure having a generally planar bottom surface and an upper surface which, in the preferred form of the invention shown in the accompanying drawings, is provided with a large, deep generally cylindrical cavity. Securing means are provided to secure the elongated load bearing device to the mounting structure, and to this end a rubber-like crutch or cane tip is mounted within the cavity, the tip being retained within the cavity by a rubber-like cord which passes through a small aperture below the cavity, the cord having an enlarged portion which engages the bottom surface of the mounting structure. Engaging means project downwardly from the bottom surface of the mounting structure, the engaging means including a plurality of spaced apart bristle tufts, and a plurality of rubber fingers interspersed among the bristle tufts. In the preferred form illustrated the rubber fingers are formed by coating alternating bristle tufts with neoprene.

The above object and other objects and advantages of this invention will become more apparent from a consideration of the following detailed description taken in conjunction with the accompanying drawings in which one preferred form of this invention is illustrated.

DETAILED DESCRIPTION

Figures 1, 2, 3, 4, 5:
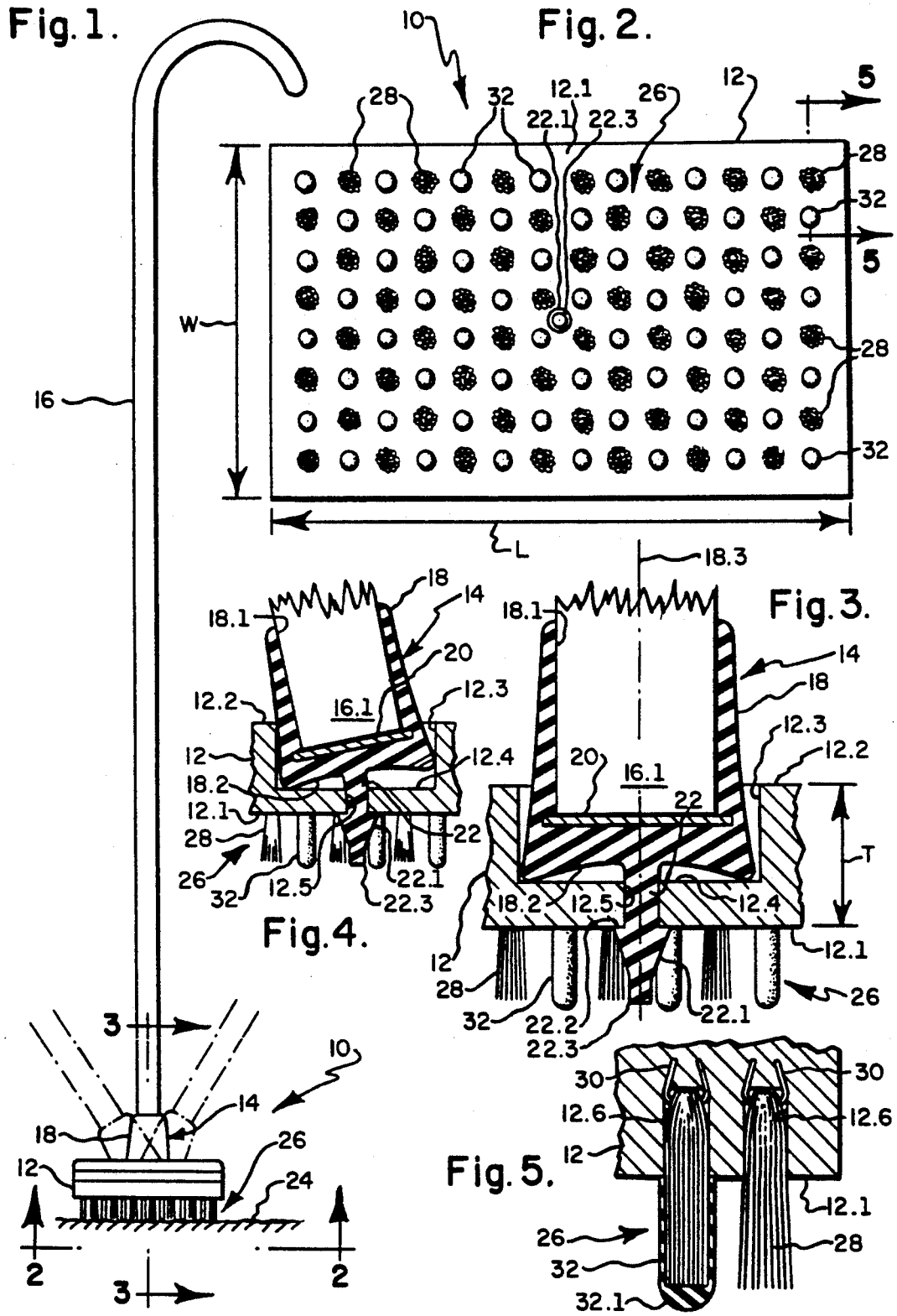
FIG. 1 is a side elevational view of the support foot assembly of this invention shown associated with a walking cane, the walking cane being shown in full lines in its normal upright position, where it may be supported by the support foot assembly of this invention, and being shown in various positions of extension in broken lines.
FIG. 2 is a bottom view of the support foot assembly of this invention, this view being taken generally along the line 2—2 in FIG. 1.
FIG. 3 is a sectional view taken generally along the line 3—3 in FIG. 1.
FIG. 4 is another sectional view taken through one of the dotted line positions shown in FIG. 1.
FIG. 5 is a sectional view taken generally along the line 5—5 in FIG. 2 showing a bristle tuft and a rubber finger in accordance with the principles of this invention.

With reference now to the various figures, the support foot assembly of this invention is illustrated generally at 10. The support foot assembly is designed for use with elongated load bearing devices such as a cane or crutch, and is illustrated in the drawing in use with a cane 16. It may also be used with stilts, or as feet for ladders. The support foot assembly includes a mounting structure 12 having a generally planar bottom surface 12.1 and an upper surface 12.2. A large, deep, generally cylindrical cavity 12.3 is located on the top surface, the bottom 12.4 of the cavity 12.3 being generally parallel to the bottom surface 12.1 of the mounting structure 12. A relatively small aperture 12.5 extends from the center of the bottom 12.4 of the cylindrical cavity for reasons which will be explained later.

Securing means, indicated generally at 14, are provided for securing an elongated load bearing device, such as the cane 16, to the mounting structure 12. The securing means includes a rubber-like cane or crutch tip 18, or its equivalent, which tip is disposed within the cavity 12.3 with its bottom resting upon the bottom surface 12.4 of the cavity. The tip 18 as illustrated is similar to conventional prior art cane tips and is generally circular in cross section and has a cylindrical recess 18.1 which may receive the end 16.1 of the cane 16. As is conventional, a metal washer 20 is retained at the bottom of the cylindrical recess 18.1 to prevent undue wear between the end 16.1 of the cane and the bottom of the recess 18.1. The bottom 18.2 of the cane or crutch tip is slightly domed shaped as can best be seen in FIG. 3. However, its peripheral edge lies in a plane normal to the axis 18.3 of the cylindrical recess.

Retaining means in the form of a rubber-like cord is provided to retain the rubber-like cane or crutch tip 18 on the support surface 12.4 of the mounting structure 12. In the embodiment illustrated, the rubber-like cord is formed integrally with the tip 18. However, it should be obvious that the cord could be formed separately with its upper end portion passing through a suitable aperture in the tip 18, there being a head on the cord which could bear against the washer 20. In any event, the rubber-like cord has an enlarged portion 22.1 of a generally conical shape, there being an annular surface 22.2 normal to the cord which can bear against the bottom surface 12.1 of the mounting structure. The rubber-like cord is initially longer than that illustrated in the drawings, and during assembly, its tail 22.3 is pulled through the aperture 12.5, the conical portion 12.1 also being pulled through the aperture, so that the annular surface 22.2 can bear against the bottom surface 12.1. After this assembly has been completed a portion of the tail 22.3 which extends tòo far below the mounting structure will be cut off in any conventional manner.

Engaging means are provided to engage the support surface 24, the engaging means being indicated generally at 26. The engaging means includes a plurality of bristle tufts 28 which are carried by the mounting structure and extend downwardly from the bottom surface 12.1. Each tuft is formed from a plurality of relatively stiff bristles which are selected to bear the load. Tests have indicated that satisfactory results may be achieved with tufts formed from nylon bristles having a diameter of 0.008 to 0.010 inches, there being approximately 120 bristles per tuft. The thickness of the bristle may be increased if heavy loads are anticipated. Thus, tests have indicated that satisfactory results may be achieved with tufts formed from polypropylene bristles having a diameter of about 3/64 of an inch, there being only eight bristles per tuft. The plurality of individual bristles, which form each tuft, are stapled into place by means of a staple 30. To this end, the bristles which form each tuft are initially formed into a U-shape. The U-shaped bristles are then placed within an associated aperture 12.6 of the mounting structure for stapling. This is best illustrated in FIG. 5.

In addition to the bristle tufts, the engaging means also includes a plurality of rubber fingers 32. In the illustrated embodiment the rubber fingers 32 are formed by coating interspersed bristle tufts with neoprene. Tests have indicated that rubber fingers by themselves do not have the desired load carrying capacity, but that by coating bristles with neoprene the desired load carrying capacity can be achieved. In addition, it has been found that the mixture of bristles and rubber-like fingers give better results on substantially all surfaces than either just bristles tufts or rubber fingers.

In the preferred embodiment the mounting structure is a rectangular parallelepiped have a length L of approximately 4.5 to 5.0 inches, and a width W of approximately 2.5 to 3.0 inches. The mounting structure also has a thickness T of approximately 1.0 inches. Each tuft extends below the bottom surface of the mounting structure approximately 0.5 inches. As can be seen the mounting structure is provided with 14 columns and 8 rows of bristle tufts and rubber fingers. In the manufacture of the support foot assembly of this invention, even tufts in even rows are coated with neoprene, and odd tufts in odd rows are coated with neoprene to form a diamond-like pattern of rubber fingers. While not illustrated, all of the tufts on each short side, that is to say the tufts at the end of each row, may be coated with neoprene to provide for better wear for the ends of the support foot assembly.

In use with a cane, it is envisioned that the length of the support foot assembly will parallel the direction of movement of the user of the cane. By having engaging means which occupy a relatively large surface area it is possible for the cane to be supported in an upright position by the support foot assembly of this invention when the bristle tufts and rubber fingers are resting upon a relatively horizontal walking surface 24. This feature is illustrated in FIG. 1. In addition, when in use, the large area of the support foot assembly will give better visibility to the user when placing the cane. Additionally, the bristles will take on the contour of any surface, indoors and out, and in all seasons, and on most all surfaces. This device has been found to be self cleaning and dust accumulation does not occur, therefore giving good adherence on wood surfaces as well as wet floors. Finally, due to the flexible mount between the cane end 16.1 and the mounting structure 12, the engaging means will be in contact with the support surface, even when extended, as shown by the dotted line positions in FIG. 1, therefore giving the user of a cane a sense of security not possible with conventional cane and crutch tips. There will be corresponding advantages when the support foot assembly of this invention is used with other elongated load bearing devices, such as crutches, stilts, and ladders, with the possible exception that the area of the bristles may not be large enough to insure that the crutch or other device may stand by itself.

While a preferred form of this invention has been described above and shown in the accompanying drawings, it should be understood that the applicant does not intend to be limited to the particular details described above and illustrated in the accompanying drawings, but intends to be limited only to the scope of the invention as defined by the following claims.

What is claimed is:

1. A support foot assembly which may be used with an elongated load bearing device such as a cane or crutch, which support foot assembly is capable of adhering to substantially all support surfaces without slipping, including ice, snow, wet floors, wood, and carpet; the support foot assembly comprising:

a mounting structure having a generally planar bottom surface and an upper surface;

securing means for securing an elongated load bearing device to the mounting structure; and engaging means to engage a support surface, said engaging means including a plurality of bristle tufts carried by the mounting structure and extending downwardly from the bottom surface, each tuft being formed of a plurality of relatively stiff bristles, and a plurality of rubber-like fingers carried by the mounting structure and extending downwardly from the bottom surface, the rubber-like fingers being interspersed among the bristle tufts.

2. The support foot assembly as set forth in claim 1 wherein the securing means includes a rubber-like cane or crutch tip provided with a cylindrical recess which may receive one end of an elongated load bearing device; and retaining means to retain the rubber-like cane or crutch tip upon a portion of the mounting structure with the cylindrical recess being normal to the bottom surface of the mounting structure.

3. The support foot assembly as set forth in claim 1 wherein the rubber-like fingers are tufts of bristles covered with neoprene or the like.

4. A support foot assembly for use with an elongated load bearing device such as a cane or crutch, which support foot assembly is capable of adhering to substantially all support surfaces without slipping, including ice, snow, wet floors, wood, and carpet, and which support foot assembly, when used with a cane, gives the user of a cane security when the cane is extended far in front of the user, and which will also permit the cane to stand by itself; the support foot assembly comprising:

a mounting structure having a generally planar bottom surface and an upper surface;

a rubber-like cane or crutch tip provided with a cylindrical recess which may receive one end of an elongated load bearing device;

retaining means to retain the rubber-like cane or crutch tip upon a portion of the mounting structure with the cylindrical recess being normal to the bottom surface of the mounting structure; and a plurality of bristle tufts carried by the mounting structure and extending downwardly from the bottom side, each tuft being formed of a plurality of relatively stiff bristles, selected tufts of bristles being covered with neoprene or the like, whereby the uncovered bristles and the neoprene covered bristles, acting together, give good adhesion to all support surfaces, the tufts covering an area of the bottom surface large enough to permit a cane, when received within the rubber-like cane or crutch tip, to stand by itself when the tufts are in engagement with a relatively horizontal support surface.

5. The support foot assembly as set forth in claim 4 wherein each tuft extends below the bottom surface of the mounting structure approximately 0.5 inches.

6. The support foot assembly as set forth in claim 4 wherein the mounting structure is provided with a large generally cylindrical cavity in the upper surface, the rubber-like cane or crutch tip being received within the cylindrical cavity.

7. The support foot assembly as set forth in claim 6 wherein the mounting structure is provided with a relatively small aperture which extends from the bottom of the cylindrical cavity to the bottom surface, and wherein the retaining means is a rubber-like cord which passes through the relatively small aperture, the rubber-like cord having an enlarged portion which engages the bottom surface of the mounting structure in order to retain the cane or crutch tip within the cylindrical cavity.

8. The support foot assembly as set forth in claim 4 wherein each bristle in each tuft is formed of a plastic having a thickness in the range of 0.080 to 3/64 inches.

9. The support foot assembly as set forth in claim 8 wherein the plastic is nylon, and the bristles have a thickness in the range of 0.008 to 0.012 inches.

10. The support foot assembly as set forth in claim 8 wherein the plastic is polypropylene, and the bristles have a thickness of about 3/64 inches.

11. The support foot assembly as set forth in claim 4 wherein the tufts of bristles are in a rectangular grid, one side of the grid being longer than the other.

12. The support foot assembly as set forth in claim 11 wherein the selected tufts covered with neoprene form a diamond-like pattern.

13. The support foot assembly as set forth in claim 12 wherein all the tufts on each short side is coated with neoprene.

14. A support foot assembly for use with an elongated load bearing device such as a cane or crutch, which support foot assembly is capable of adhering to substantially all support surfaces without slipping, including ice, snow, wet floors, wood, and carpet, which gives the user of a cane security when the cane is extended far in front of the user, and which will also permit a cane to stand by itself; the support foot assembly comprising:

a rectangular parallelepiped mounting structure approximately 4.5 to 5.0 inches long by approximately 2.5 to 3.0 inches wide, the mounting structure having an upper surface and a generally planar bottom surface, there being a deep cylindrical cavity centrally located on the top surface of the mounting structure, the bottom of the cavity being generally parallel to the bottom surface of the mounting structure;

a rubber-like cane or crutch tip disposed within the cavity, the cane or crutch tip being circular in cross section and having a cylindrical recess which may receive one end of a cane or crutch, the rubber-like cane or crutch tip having a bottom surface normal to the cylindrical recess;

retaining means to retain the rubber-like cane or crutch tip within the deep cavity with the bottom surface of the rubber-like cane or crutch tip in contact with the bottom surface of the cylindrical cavity; and a plurality of bristle tufts carried by the mounting structure and extending downwardly from the bottom side, each tuft extending below the bottom surface of the mounting structure approximately 0.5 inches, and each tuft being formed of a plurality of relatively stiff bristles, selected tufts of bristles being covered with neoprene or the like, whereby the uncovered bristles and the neoprene covered bristles, acting together, give good adhesion to all support surfaces.

15. The support foot assembly as set forth in claim 14 wherein the mounting structure is provided with 14 columns and 8 rows of bristle tufts.

16. The support foot assembly as set forth in claim 15 wherein even tufts in even rows are covered with neoprene, and odd tufts in odd rows are covered with neoprene to form a diamond-like pattern.

17. The support foot assembly as set forth in claim 16 wherein all the tufts on the end of each row are coated with neoprene.

18. The support foot assembly as set forth in claim 14 wherein the mounting structure is approximately 1 inch thick.

19. The support foot assembly as set forth in claim 14 wherein the mounting structure is provided with a relatively small aperture which extends from the bottom of the deep cylindrical cavity to the bottom surface, and wherein the retaining means is a rubber-like cord which passes through the relatively small aperture, the rubber-like cord having an enlarged portion which engages the bottom surface of the mounting structure in order to retain the cane or crutch tip within the cylindrical cavity.

20. The support foot assembly as set forth in claim 19 wherein the rubber-like cord is formed integrally with the cane or crutch tip.

* * * * *